US010753347B2

(12) United States Patent
Hou et al.

(10) Patent No.: US 10,753,347 B2
(45) Date of Patent: Aug. 25, 2020

(54) WOBBLE PLATE PISTON PUMP FOR LOW FLOW GAS AND ELECTRIC WATER PRESSURE WASHERS

(71) Applicant: Active Products Inc., Toronto (CA)

(72) Inventors: James Hou, Toronto (CA); Jiang-yong Gu, Shanghai (CH); Ming Liu, Toronto (CA); Man Chung Kenneth Lam, Toronto (CA)

(73) Assignee: Active Products Inc., Toronto (CA)

( * ) Notice: Subject to any disclaimer, the term of this patent is extended or adjusted under 35 U.S.C. 154(b) by 0 days.

(21) Appl. No.: 16/017,533

(22) Filed: Jun. 25, 2018

(65) Prior Publication Data

US 2018/0313341 A1 Nov. 1, 2018

Related U.S. Application Data

(63) Continuation of application No. PCT/CA2016/051158, filed on Oct. 5, 2016.
(Continued)

(30) Foreign Application Priority Data

Jun. 20, 2016 (CN) ..... 2016 1 0443275
Jun. 20, 2016 (CN) ..... 2016 2 0606037

(51) Int. Cl.
*F04B 1/148* (2020.01)
*F04B 1/12* (2020.01)
(Continued)

(52) U.S. Cl.
CPC ..... *F04B 1/148* (2013.01); *F04B 1/12* (2013.01); *F04B 1/14* (2013.01); *F04B 1/28* (2013.01);
(Continued)

(58) Field of Classification Search
CPC .. F04B 1/148; F04B 1/16; F04B 1/188; F04B 1/28; F04B 1/295
See application file for complete search history.

(56) References Cited

U.S. PATENT DOCUMENTS 2,238,252 A * 4/1941 Davis, Jr. ..... F04B 1/128 417/287
3,074,345 A * 1/1963 Scheflow ..... F04B 1/28 417/270
(Continued)

FOREIGN PATENT DOCUMENTS

CN 201558824 U 8/2010
CN 203098170 7/2013
(Continued)

OTHER PUBLICATIONS

Written Opinion of the International Searching Authority corresponding to PCT/CA2016/051158 indicating claims 2, 3, and 11 have novelty and inventive step (corresponding to current claims 1, 2 and 9 of the present application); Canadian Intellectual Property Office; dated Dec. 8, 2016.
(Continued)

*Primary Examiner* — Kenneth J Hansen
(74) *Attorney, Agent, or Firm* — Bhole IP Law; Anil Bhole; Marc Lampert

(57) ABSTRACT

There is provided a wobble plate piston water pump for use in a pressure washer and driven by a driving source, the water pump includes a pump body, a wobble plate, four or more pistons and a water passage defined by a water inlet and a water outlet. The driving source being electric powered and having a power consumption of less than or equal to a 15 ampere draw at 120 volts or 220 volts or the driving source being gas powered and having an engine displacement of less than or equal to 250 cubic centimetres.

7 Claims, 5 Drawing Sheets

Related U.S. Application Data

(60) Provisional application No. 62/332,808, filed on May 6, 2016.

(51) Int. Cl.
*F04B 1/14* (2020.01)
*F04B 17/05* (2006.01)
*F04B 1/28* (2006.01)

(52) U.S. Cl.
CPC ..... *F04B 17/05* (2013.01); *F04B 2203/0201* (2013.01); *F04B 2203/0202* (2013.01); *F04B 2203/0604* (2013.01)

(56) References Cited

U.S. PATENT DOCUMENTS 3,257,960 A * 6/1966 Keel ..... F04B 1/14 417/269
3,376,822 A * 4/1968 Leduc ..... F04B 1/146 92/12.2
5,529,460 A * 6/1996 Eihusen ..... B08B 3/026 239/124
5,975,863 A * 11/1999 Mazzucato ..... F04B 1/148 417/269
9,051,927 B2 6/2015 Gilpatrick et al.
9,316,216 B1 4/2016 Cook et al.

FOREIGN PATENT DOCUMENTS

CN 204371575 6/2015
CN 204371575 U * 6/2015 ..... F04B 1/18

OTHER PUBLICATIONS

International Search Report corresponding to PCT/CA2016/051158; Canadian Intellectual Property Office; dated Dec. 8, 2016.
Extended European Search Report for EP application No. 16900782.0; European Patent Office; dated Sep. 30, 2019.

* cited by examiner

WOBBLE PLATE PISTON PUMP FOR LOW FLOW GAS AND ELECTRIC WATER PRESSURE WASHERS

TECHNICAL FIELD

The following relates generally to a water pump and more specifically to a wobble plate piston water pump for use in a low flow gas pressure washer or a low current electric pressure washer.

BACKGROUND

A multitude of household and light commercial pressure washers are on the market. These washers, for the purposes of the following, are those that provide pressurized water at under 3500 pounds-per-square-inch (psi) with a water flow rate of less than 3.0 gallons per minute (gpm).

The vast majority of these pressure washers, if not all of them, employ either an electric brushed or induction motor, or a gas powered engine, that drives a wobble plate pump. The wobble plate displaces three pistons that alternatingly draw water from an inlet and drive pressurized water through an outlet. The use of three pistons is generally ubiquitous.

Efforts to increase the power of a pressure washer would generally include altering certain elements of the water pump, such as increasing motor strength or replacing the brushed motor with a brushless motor. However, these conventional alterations generally result in impairments that make the pressure washer impractical, overly expensive, and/or non-functional.

SUMMARY

In an aspect, there is provided a wobble plate piston water pump for use in a pressure washer and driven by a driving source, the driving source being electric powered and having a power consumption of less than or equal to a 15 ampere draw at 120 volts or 220 volts or the driving source being gas powered and having an engine displacement of less than or equal to 250 cubic centimetres, the water pump includes: a pump body defining a plurality of channels; a wobble plate disposed in the pump body and having a rear side and a front side, the wobble plate being rotatable around a rotational axis via mechanical connection on the rear side to the driving source, the front side being inclined at an angle relative to the rotational axis; four or more pistons each having a proximate end and a distal end, each piston located in a respective one of the plurality of channels and each having a thrust ball bearing located on the proximate end, the thrust ball bearing of each piston being biased to contact the front side of the wobble plate, the pistons being reciprocatable within the channel along an axis transverse to the rotational axis during rotation of the wobble plate; and a water passage defined by a water inlet and a water outlet each in selective fluid communication with one of the plurality of channels based on the phase of reciprocation of the respective piston for that channel, the water inlet providing low pressure water to the channel while the respective piston for that channel is moving away from the water inlet, and the water outlet receiving high pressure water from the channel while the piston is moving towards the water outlet.

In a particular case, the four or more pistons consist of five pistons.

In a further case, the four or more pistons consist of six pistons.

In another case, the wobble plate piston water pump further includes a power-off subassembly located intermediate the water outlet and a closeable water nozzle, the power-off subassembly defining a push rod cavity for receiving water from the water outlet, the power off subassembly includes: a push rod at least partially located in the push rod cavity, the push rod moveably biased towards being in the push rod cavity; and a microswitch electrical connected to a power supply of the driving source, the microswitch positioned such that push rod contacts the microswitch when the push rod cavity is substantially filled with water due to a closed water nozzle, and contact with the microswitch by the push rod turns off power to the driving source.

In yet another case, the driving source is an electric motor and the diameter of each of the pistons is between 8 mm and 14 mm.

In yet another case, the driving source is a gas engine and the diameter of each of the pistons is between 10 mm and 16 mm.

In yet another case, the driving source is an electric motor and the angle of the front side of the wobble plate is between 5 degrees and 8 degrees.

In yet another case, the driving source is a gas engine and the angle of the front side of the wobble plate is between 6 degrees and 10 degrees.

In yet another case, the wobble plate piston water pump further includes a transmission subassembly located intermediate the driving source and the wobble plate, the transmission subassembly configured to rotate the wobble plate between four to six times the rate of reciprocating each of the pistons.

In another aspect, there is provided a method for pumping out high-pressure water from a low pressure water source using a wobble plate piston water pump driven by a driving source, the driving source being electric powered and having a power consumption of less than or equal to a 15 ampere draw at 120 volts or 220 volts or the driving source being gas powered and having an engine displacement of less than or equal to 250 cubic centimetres, the method includes: rotating a wobble plate around a rotational axis via mechanical connection to the driving source, a front side of the wobble plate being inclined at an angle relative to the rotational axis; biasing four or more pistons towards the front side of the wobble plate with a thrust ball bearing disposed intermediate each of the pistons and the wobble plate; reciprocating the four or more pistons in separate channels along an axis transverse to the rotational axis during rotation of the wobble plate, the channels defined by a pump body; receiving low pressure water from a water inlet to at least one of the channels when the piston for that respective channel is moving away from the water inlet; and providing high pressure water to a water outlet from at least one of the channels when the piston for that respective channel is moving towards the water outlet.

In a particular case, the biasing of the four or more pistons consists of biasing exactly five pistons and the reciprocating of the four or more pistons consists of reciprocating exactly five pistons.

In another case, expelling the high-pressure water includes expelling the high-pressure water to a closeable water nozzle, and wherein the method further includes ceasing reciprocation of the pistons if the closeable water nozzle is closed.

These and other aspects are contemplated and described herein.

DESCRIPTION OF THE DRAWINGS

A greater understanding of the embodiments will be had with reference to the Figures, in which.

DETAILED DESCRIPTION

Figure 1:
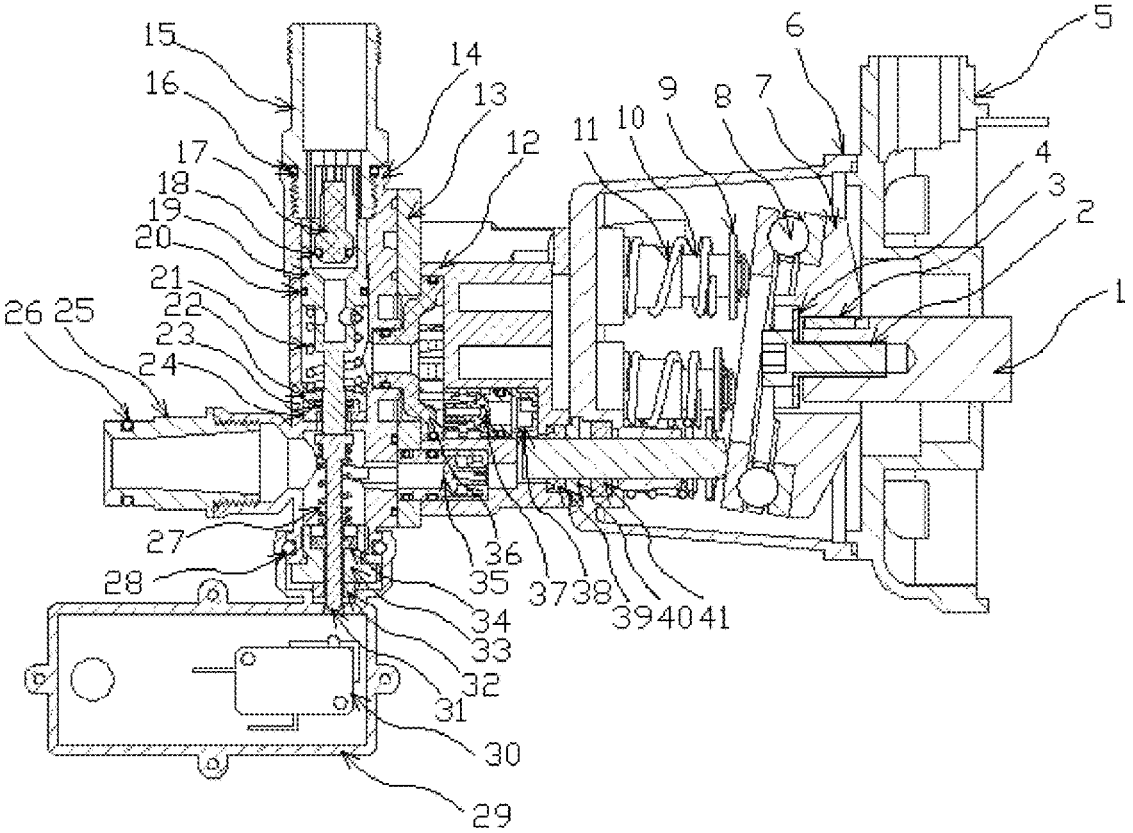
FIG. 1 and FIG. 2 illustrate a cross-sectional side view of a wobble plate piston water pump according to an embodiment.
Figure 2:
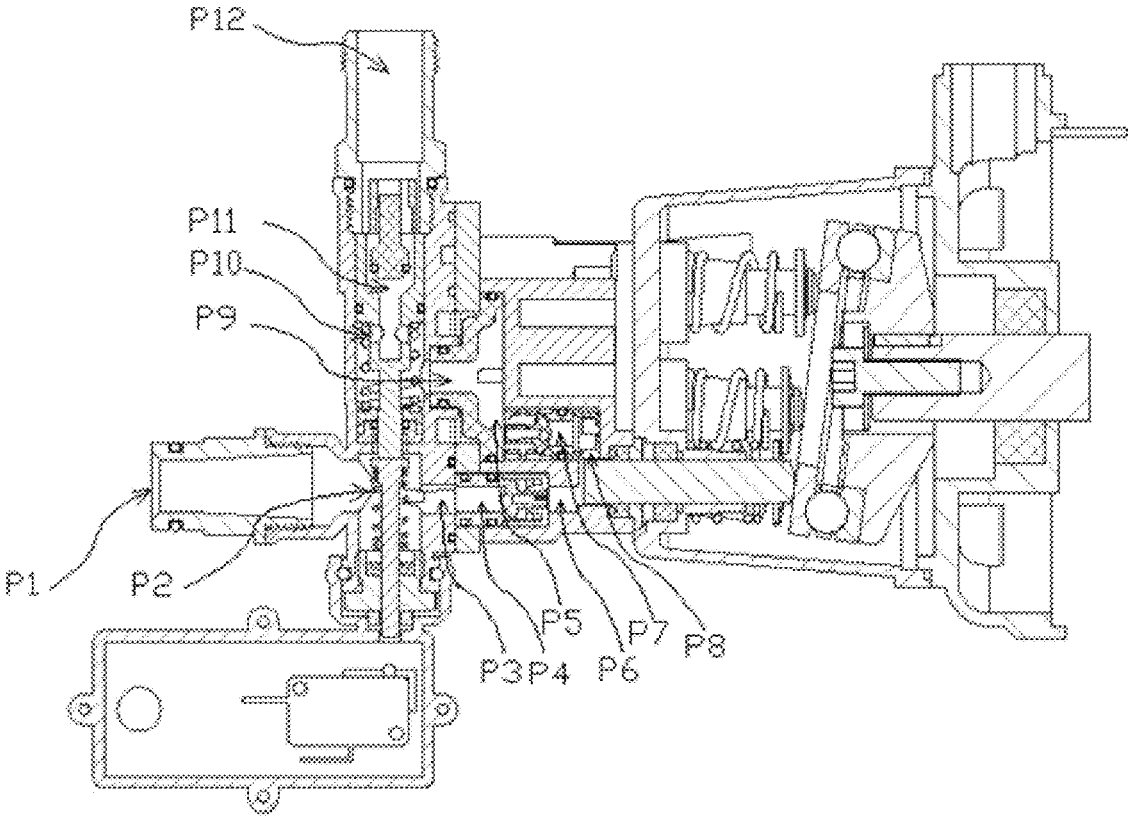

Embodiments will now be described with reference to the figures. For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practised without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Conventional three piston water pumps are typically used for low flow pressure washers because they have a simple structure and easy to manufacture. However, there are certain problems with their performance; for example, low working efficiency, large vibration, high noise, short life, and relatively high requirements for starting torque on a motor. For regions employing low-voltage power supply systems, such as in North America, the problems of the three piston water pump become more prominent. For example, the induction motor of the pump may fail to work properly because of the low starting torque of the motor due to having to work at low voltage.

Applicant has recognized that for conventional three piston water pumps, altering a single element of the pump will not necessarily increase performance for a water pump, and in some circumstances, may even reduce performance. Through repeated testing and study, Applicant recognized the following set of mechanical propositions for piston-type water pumps when a single element of the pump was altered:

(a) decreasing the piston diameter will decrease the desired driving torque of the pump, increase the efficiency of the pump, and decrease the working current of the pump;

(b) shortening the piston stroke will decrease the desired driving torque of the pump, decrease the vibration of the pump, and decrease the working current of the pump;

(c) decreasing the pitch circle of the wobble plate of the pump will decrease the desired driving torque of the pump, decrease the vibration of the water pump, and decrease the working current of the pump; and (d) changing the revolutionary frequency of the piston outside of a range of approximately 2200 revolutions/min to 4000 revolutions/min can seriously affect the life of the pump; whereby below this range the efficiency of the pump decreases too greatly, such that the pump can fail to work properly; and whereby above this range the motor of the pump can be too easily overloaded.

By way of example for proposition (a), if the diameter of a piston of the pump is decreased, for example, from a diameter of 12 mm to 10 mm, and all other parameters are unchanged, the starting torque of the motor will be reduced and the vibrational effects will also be reduced. However, according to hydromechanics formulae and Applicant's actual testing, decreasing the diameter has a negative effect. Namely, decreasing the diameter will reduce the working performance of the pump such that both the working pressure and flow of the pump become greatly reduced. If a smaller diameter piston is used, while the other working constraints are unchanged, only the movement stroke of the piston can be increased. However, this will cause increased vibration, reduced efficiency and will require a large starting torque on the motor.

By way of example for proposition (b), if the stroke of the piston is shortened, for example, by reducing the angle of pump's wobble plate, and all the other parameters are unchanged, the working pressure and the of the pump will be greatly diminished. Although a reduction of the eccentric moment borne by the motor spindle may be achieved, and the vibrational effects and the starting torque of the pump may be improved, the performance of the pump will be greatly decreased. If a pump has a shortened stroke, and all other elements are unchanged, only the diameter of the piston can be increased to compensate. However, this will lead to increased vibrational effects and require a large driving torque on the motor. Thus, it will fail to improve the efficacy of the pump.

By way of example for proposition (c), if the pitch circle of the wobble plate is decreased such that the pitch circle of the wobble plate for a three piston water pump has reached a critical value for remaining functional, the reduction of the pitch circle can only be realized by reducing the diameter of the pump's piston. However, generally this cannot also improve the performance of the pump as stated in proposition (a), and therefore, improving the performance of the pump just by reducing the pitch circle of the wobble plate is not feasible.

Accordingly, Applicant has determined that comprehensively improving the performance of a three piston water pump by merely altering elements or making local improvements is generally impractical. Such impracticality is likely why product performance of such pumps has not materially gained any significant progress for possibly decades.

The above impairments are especially concerning for low flow gas pressure washers or low current electric water pressure washers. Such as where the driving source is electric powered and has a power consumption of less than or equal to a 15 ampere draw at 120 volts or 220 volts; or where the driving source is gas powered and has an engine displacement of less than or equal to 250 cubic centimetres.

In light thereof, Applicant has now discovered that by modifying a wobble plate piston water pump for low flow gas pressure washers or low current electric water pressure washers to utilize more than three pistons it is possible to provide at least one of the advantages of: a more efficient water pump, a more consistent fluid output, a reduction in the required driving torque, a reduction in vibrational effects, a reduction in manufacturing complexity, an increase in product reliability, and a minimal impact in cost.

Referring now to FIG. 1, an exemplary embodiment of a wobble plate piston water pump is shown in cross-sectional side view. The motor is shown as an induction motor and the pump is a wobble plate pump.

In the embodiment of FIG. 1, the wobble plate piston water pump includes a high-pressure generation subassembly, a pressure retaining subassembly, a mechanical-electronic pressure safety control subassembly and a cleaning solution auto-generation subassembly. In further embodiments, the wobble plate piston water pump may not be delineated into subassemblies, or may be delineated into more or less subassemblies, each having or sharing different configurations of the disclosed components.

The wobble plate piston water pump includes a pump body which is made up of a front pump body 14, an intermediate pump body 13, and a rear pump body 12.

The wobble plate piston water pump includes four or more pistons 10 (also called plungers) each located in the high-pressure generation subassembly. The high-pressure generation subassembly is composed of a wobble plate 7 (also called a tilting tray), thrust ball bearings 8, a plurality of pistons 10 and piston springs 11. The wobble plate 7 has a front side and a rear side. The rear side of the wobble plate 7 is in mechanical connection with a driving source 5. The mechanical connection can be via affixation to a front end of a rotating spindle 1 (also called a shaft) of the driving source 5. The wobble plate 7 is mounted at an angle offset from the vertical, relative to the spindle, by a particular offset. The wobble plate 7 is affixed to a lateral end of the spindle 1 through a bolt 2, a shaft key 3 and a washer 4. However, any structure for affixing the wobble plate 7 to the spindle 1 may be used.

Each of the plurality of pistons 10 have a proximate end and a lateral end. The thrust ball bearings 8 are located at the proximate end of each of the pistons 10. The plurality of pistons 10 are disposed adjacent and in contact, via the thrust ball bearings 8, with the wobble plate 7. The contact is maintained by a spring 11 disposed between a spring retainer 9 part of the piston 10 adjacent the wobble plate 7 and a distal wall of a channel P6. The spring 11 is biased to urge the piston 10 toward the wobble plate 7. The wobble plate 7 rotates with the shaft 1, which causes each piston to reciprocate in the channel P6 along an axis transverse to the rotation of the wobble plate 7, due to following along with the angled front side of the wobble plate 7.

The plurality of pistons 10 are positioned to be concentrically and uniformly distributed around the wobble plate 7. The thrust ball bearings 8 provided on the wobble plate 7 are biased towards a movable ring of the thrust ball bearings 8 under the action of the piston springs 11. Thus, with rotation of the spindle 1 as described, the wobble plate 7 and the thrust ball bearings 8 make an annular movement along an axis of the motor 5, and under the compression force of the bearing 8 and the piston springs 11, and the pistons 10 make a horizontal reciprocating movement simultaneous to the rotation of the bearing 8. Since the pistons 10 are approximately concentrically distributed in an annular direction, the horizontal positions of the pistons 10 are also uniformly annularly distributed over the front side of the wobble plate 7; such that each of the pistons are at different distances from the distal end of the corresponding channel at any one time. In particular cases, the Applicant has determined that it is advantageous for the pitch diameter to be between 35 mm to 60 mm for an electric-powered pump and between 40 mm to 80 mm for a gas-powered pump.

The high-pressure generation subassembly also includes a transmission box body 6, a piston elastic retainer ring 9, an oil-proof sealing ring 41, a high-pressure water outlet joint 15, the front pump body 14, a first O-shaped ring 16 and a non-reflux check valve 17. The transmission box body 6 is connected, typically with a front end cover, to the motor 5 (or an engine). The piston elastic retainer ring 9 is positioned at the rear end of the piston 10. The oil-proof sealing ring 41 is mounted on a rear of the pump and is concentric with the piston 10. The high-pressure water outlet joint 15 is connected with a front pump body 14 through threads. The non-reflux check valve 17 is mounted at the inner side of the high-pressure water outlet joint 15.

The pressure retaining subassembly includes the rear pump body 12, the intermediate pump body 13, water inlet check valves 35, water outlet check valves 37, check valve inner sleeves 38, a waterproof sealing ring 39, a sealing ring fixing ring 40, a check valve support frame 36, a low-pressure water inlet joint 26 and a fifth O-shaped ring 26. The water inlet check valves 35 are mounted in small cavities that are uniformly distributed in a annular direction between the intermediate pump body 13 and the rear pump body 12. The water inlet check valve 35 generally provides a high flow and low pressure water source. Each inlet check valve 35 is in fluid communication with at least one of the pistons 10, a low pressure chamber P2, and a low-pressure cavity water outlet P3. The water outlet check valve 37 generally constraints the flow of fluid, for example using a smaller diameter conduit than the fluid inlet. The water outlet check valves 37 and the check valve inner sleeves 38 are mounted in independent small cavities of the rear pump body 12 and are uniformly distributed in a annular direction. A water inlet P7 of each of the water outlet check valves 37 is in fluid communication with a water outlet P6 of the corresponding water inlet check valve 35 through an adjacent small side hole P8. A water outlet P5, having water outlet entrance P4, of each of the water outlet check valves 37 is in fluid communication with a through-hole P9 of the check valve support frame 36. The waterproof sealing ring 39 and the sealing ring fixing ring 40 are mounted on the rear pump body 12 and are concentric with the piston 10. The low-pressure water inlet joint 26 is directly connected with the front pump body 14.

The mechanical-electronic pressure safety control subassembly consists of an overflow valve core 19, a second O-shaped ring 18, a third O-shaped ring 20, an overflow valve main spring 21, a pressure ring 22, a fourth O-shaped ring 23, a valve rod support ring 24, the fifth O-shaped ring 26, a power-off push rod spring 27, a microswitch box 29, a microswitch 30, a power-off push rod 31, a push rod support ring 32, a push rod locking nut 33 and a push rod waterproof sealing ring 34. The microswitch 30 is mounted in the microswitch box 29. An internal wire (not shown) connected with the microswitch 30 is connected with a motor outgoing line (not shown). The microswitch box 29 is fixed to the front pump body 14 through a U-shaped pin 28, the power-off push rod 31, the power-off push rod spring 27, the push rod support ring 32, the push rod locking nut 33 and the push rod waterproof sealing ring 34, which are mounted in a push rod cavity of the front pump body 14. The power-off push rod 31 is concentric with a small hole in the microswitch box 29 and is aligned to a microswitch key (not shown). The overflow valve core 19, the overflow valve main spring 21, the pressure ring 22 and the valve rod support ring 24 are mounted in an overflow valve cavity that is concentric with the push rod cavity, and the two cavities are in mechanical communication through a small hole.

The cleaning solution auto-generation subassembly includes a Venturi valve (not shown) and a cleaning solution check valve (not shown).

Applicant has determined that for water pumps with greater than three pistons uniformly distributed in a annular direction, and where the pitch circle of each piston is required to be smaller than the pitch circle of the thrust bearing, the pistons for an electric motor can have for example a size of between 8 mm and 14 mm and the pistons for a gasoline engine can have for example a size of between 10 mm and 16 mm.

The motor 5 can be any driving source known in the art; for example, a gasoline engine or an electric motor. Electric motors for the purposes of this disclosure can be generally divided into two categories, induction motors and series-wound motors. Each category can be further divided into a low-voltage type motors (100V to 120V) and a high-voltage (and high-pressure) type motors (200V to 240V) according to different power supplies. In a particular case of the embodiments described herein, the driving source can be electric powered and have a power consumption of less than or equal to a 15 ampere draw at 120 volts or 220 volts. In another case of the embodiments described herein, the driving source can be gas powered and have an engine displacement of less than or equal to 250 cubic centimetres In the present embodiment, the motor 5 is connected to a direct drive transmission; however, any suitable transmission subassembly may be used. With a direct drive transmission, the motor 5 is connected to the water pump through the wobble plate 7, whereby the wobble plate 7 is directly fixed to the spindle 1, and the rotating speed of the motor 5 is the same as the moving speed of the piston 10. In another embodiment, where a differential drive transmission is used, the wobble plate 7 is not directly connected with the motor rotor spindle 1, but the spindle 1 of the motor 5 is connected with the wobble plate 7 through a group or multiple stages of reduction gears (not shown), and the rotating speed of the motor 5 can be, for example, four to six times of the reciprocating speed of the pistons 10.

In operation, with the rotation of the spindle 1, the wobble plate 7 makes a rotational movement along an axis of the motor. As the wobble plate 7 rotates, the plurality of pistons 10 periodically reciprocate, in the channel P6, on an axis transverse to the rotation of the wobble plate 7 due to the bias of the springs 11 forcing the pistons 10 towards the wobble plate 7. In this way, the pistons 10 are forced to make a horizontal reciprocating movement simultaneous to the rotation of the wobble plate 7.

Since the pistons 10 are concentrically distributed around the wobble plate 7, the movement positions each of the pistons 10 at uniformly distributed horizontal positions throughout the rotational cycle. For example, at a certain point in time in a five piston water pump, when the first piston reaches the distal end, the adjacent second piston will be moving towards the distal end and compressed ⅘ of the distance towards the distal end. The third piston (adjacent to the second piston) will be moving towards the distal end and located at ⅖ of the distance towards the distal end. The fourth piston (adjacent to the third piston) will be moving towards the proximate end and will be located at ⅕ of the distance towards the distal end. Finally, the fifth piston (adjacent to the third piston) will be moving towards the proximate end and will be located at ⅗ of the distance towards the distal end.

As each piston 10 reciprocates in the channel P6, water is sucked into a distal end of the channel P6 from the fluid inlet through the inlet check valves 35, the water is pressurized, and the pressurized water is expelled from the distal end of the channel P6 through the outlet check valves 37 to the fluid outlet at a higher pressure than the fluid inlet.

The portion of the channel P6 in front of the piston 10 forms a local vacuum in conjunction with the waterproof sealing ring 39, the water inlet check valve 35 and the water outlet check valve 37. When the piston 10 moves backwards from the distal end, the portion of the channel P6 in front of the piston is gradually expanded, and a vacuum of negative pressure formed therein also builds gradually. When the piston is fully retracted, the water inlet check valve 35 is opened and the water outlet check valve 37 remains closed. An external water source flows into the portion of the channel P6 in front of the piston from a water inlet hole P1 of a low-pressure water inlet joint 25 under the action of negative pressure. The piston 10 then moves forward toward the distal end, and the water inlet check valve 35 is closed. The portion of the channel P6 in front of the piston is gradually decreased in size and the water inside the cavity becomes pressurized. When the piston 10 reaches or approximately reaches the distal end, the water outlet check valve 37 is opened and high-pressure water flows through the water outlet check valve 37 and into a sub-pressure cavity P9. This reciprocating movement of the piston 10, with the corresponding water intake and outtake, is repeated circularly and cyclically, in turn, amongst the five pistons. Thus, the external low-pressure water source is transformed into a high-pressure water flow, which is then conveyed to the sub-high pressure cavity P9.

In this case, there is a bypass valve P11, having a bypass valve entrance P10, that is in fluid communication with a pressurized water discharge port P12. The high-pressure water outlet joint 15 forming part of the pressurized water discharge port P12.

In some cases, the wobble plate piston water pump may be connected to a closeable water nozzle (not shown) (also called a water gun). If the water nozzle is closed, the water pressure inside the sub-high pressure cavity P9 continues to raise as high pressure water is delivered. When the pressure in the sub-high pressure cavity P9 exceeds the elastic force of the overflow valve main spring 21 and the power-off push rod spring 27, the overflow valve core 19 pushes the power-off push rod 31 to move outwards. The power-off push rod 31 moves until it comes into contact with a microswitch 30. Upon contact with the microswitch 30, the microswitch 30 powers off a power supply which stops operation of both the motor 5. At this point, the wobble plate piston water pump is in a standby state. When the water nozzle is opened, the microswitch 30 is opened, the motor begins operating again, and a high pressure water flow is pumped out through the water nozzle.

In some cases, the water nozzle may be able to be set to a low-pressure mode. In this case, the water flow will generate local vacuum in front of the Venturi valve (not shown) mounted in the high-pressure water outlet joint 15. After passing through the Venturi valve at a high speed, and under the action of negative pressure, the cleaning solution check valve (not shown) is opened. In this case, the cleaning solution check valve is mounted in front of the Venturi valve. A cleaning solution is drawn into the high-pressure water outlet joint 15 from a cleaning solution receptacle and flows out of the water nozzle together with the low-pressure water flow.

Figure 3:
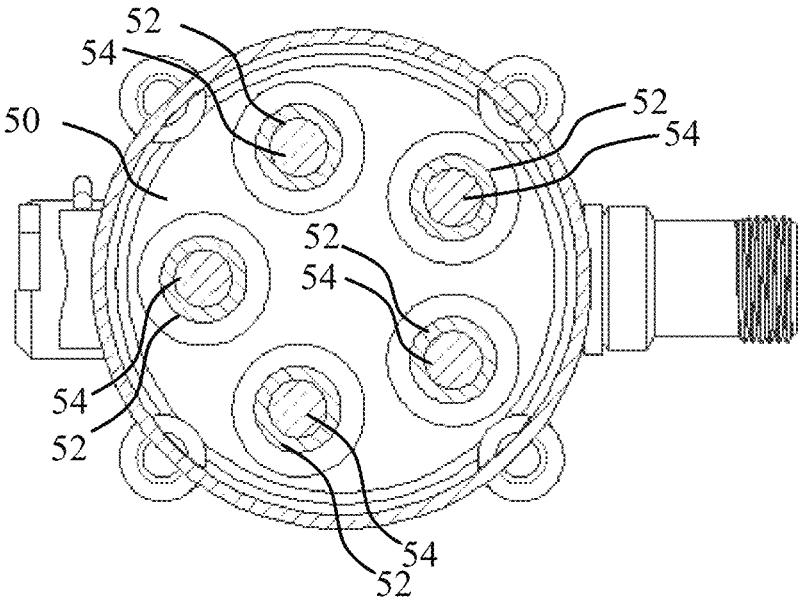
FIG. 3 illustrates a cross-sectional front view of the hydraulic schematic of the wobble plate piston water pump according to the embodiment of FIGS. 1 and 2.

An exemplary embodiment of a pump body 50 is shown in FIG. 3. The pump body 50 includes five channels 52 and correspondingly includes five pistons 54 located in the channels 52. As shown, the five pistons 54 are annular spaced around the central axis of the wobble plate (not shown).

While the exemplary embodiment of FIG. 3 illustrates a five piston arrangement, the number of pistons could be four, five, six, seven or even more. With that in mind, there is a practical constraint on the number of pistons, based on the diameter of the wobble plate, the pump piston diameter, the pitch circle diameter and the piston diameters. It is necessary to provide some separation between the channels so that fluid is not communicated between channels (i.e., leakage). Although any of these components can be custom designed, for cost reasons (purchasing certain components off the shelf) there is generally a common range of acceptable diameters.

In evaluating the embodiments described herein, the Applicant took into consideration various constraints, such as the constraints on the pistons; for example, the amperage draw, torque limitation, manufacturing cost, and the like. Further, the Applicant also took into consideration the constraints on the wobble plate, for example, the amperage draw, torque limitation, and the like.

Advantageously, for the embodiments described herein, having taken into consideration the above constraints, the Applicant has determined that the pistons can have a diameter of between 8 mm to 14 mm for an electric pressure washer and between 10 mm to 16 mm for a gas pressure washer. The Applicant has also determined that advantageously the pitch circle of the wobble plate be between 35 mm to 60 mm for an electric pressure washer and between 40 mm to 80 mm for a gas pressure washer. The Applicant also determined that the pitch circle in these circumstances generally has to be above 35 mm, and preferably above 40 mm, due to structural constraints.

Applicant has further determined that, advantageously for the embodiments described herein, a suitable wobble plate angle for a five pistons arrangement may be between 5 degrees and 8 degrees for an electric pressure washer and between 6 degrees and 10 degrees for a gas pressure washer. The Applicant also determined that the pitch circle in these circumstances generally has to be above 5 degrees or else the torque generated will be too low and not sufficiently efficient.

Figure 4:
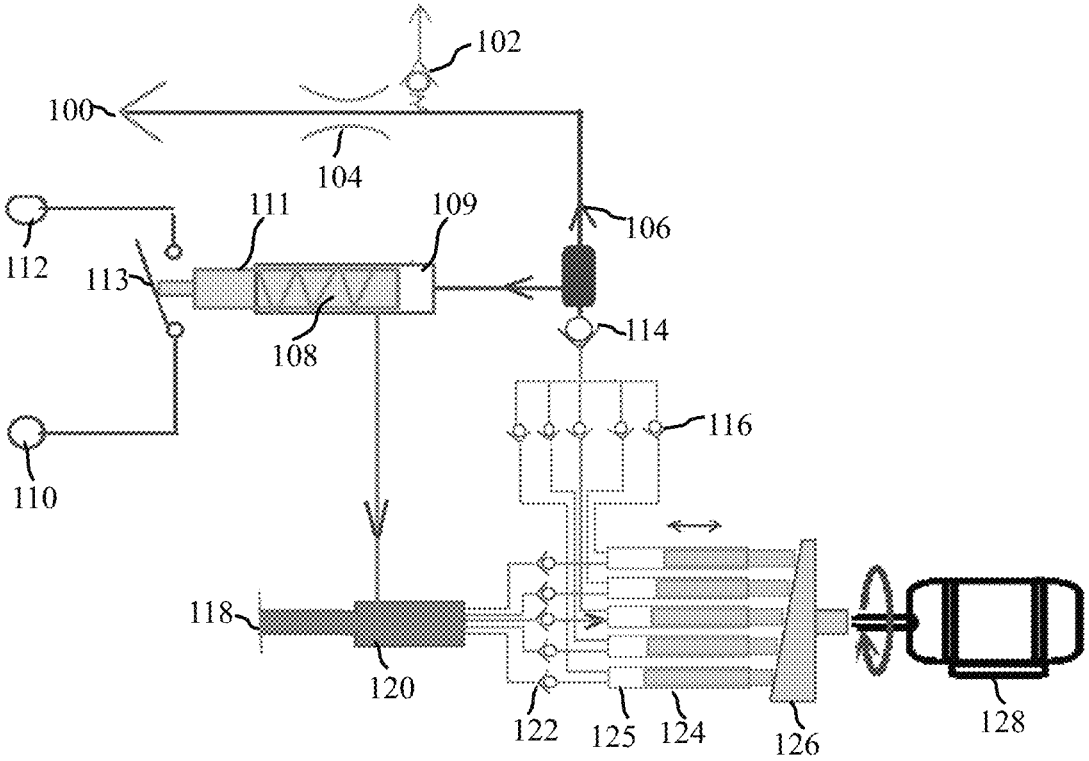
FIG. 4 illustrates a schematic view of the wobble plate piston water pump according to the embodiment of FIGS. 1 and 2.

FIG. 4 shows a schematic view of an exemplary embodiment of a five piston wobble plate piston pump for water pressure washers. A motor 128 is connected to and rotationally drives the wobble plate 126. The wobble plate 126 is in mechanical communication with the five pistons 124 to produce horizontal reciprocating motion of the pistons 124. For illustrative purposes only, the pistons 124 are shown in a linear configuration. In practice, the pistons 124 are annularly spaced around the front side of the wobble plate 126.

Each of the channels 125 is in selective fluid communication with a water passage based on the phase of reciprocation of the respective piston 124 in that channel 125. The water passage defined by a water inlet and water outlet. The water inlet check valve 122 provides water to each channel 125 when the respective piston 124 in that channel 125 is moving away from that water inlet. A low-pressure water source 118 feeds water to a low-pressure cavity 120, which then feeds water to the water inlet check valves 122.

Each of the pistons 124 is in fluid communication with a water outlet check valve 116 as part of the exit path for the pressurized water. The water outlet receives water from each channel 125 when the respective piston 124 in that channel 125 is moving towards that water outlet. Each of the water outlet check valves 116 feed into a main check valve 114.

The high-pressurized water flows along an outlet path 106 past a Venturi jet valve 104 to a water nozzle 100. In this case, there is a pressure valve 102 connected to a cleaning solution source to feed cleaning solution into the output water via fluid dynamics created by the Venturi jet valve 104.

Microswitch electrical leads 110 and 112, of a microswitch 113, are electrically connected to the power supply of the motor 128 such that the microswitch 113 can turn off the motor 128 in certain circumstances. A power-off subassembly 108 is in fluid communication with the high-pressure outlet path 106.

The power-off subassembly defines a push rod cavity 109. A push rod 111 is at least partially located in the push rod cavity 109, the push rod 111 is moveably biased towards being in the push rod cavity by, for example, a push rod spring.

When a fixed quantity of pressurized water fills the push rod cavity 109, such as when the push rod cavity 109 is substantially filled with water, a push rod 111 moves out of the push rod cavity 109 and into contact with the microswitch 113. The microswitch 113 then turns off the power to the motor 128. The microswitch 113 returns power to the motor 128 when the push rod cavity begins to empty its water and the pressurized water can once again move along the path towards the water nozzle 100.

In a further embodiment, the wobble plate water pump, as described herein, can be used for a method for pumping out high-pressure water from a low pressure water source. The method includes reciprocating four or more pistons in separate channels. Then, receiving water from the low pressure water source into a distal end of at least one of the channels when the corresponding piston is moving away from the distal end. Then, pressurizing the water by moving the corresponding piston towards the distal end of the at least one channel. Then, expelling the high-pressure water from the at least one channel prior to the corresponding piston moving away from the distal end. The receiving water to expelling water steps are sequentially repeated for each of the channels. Each of the pistons being at different distances from the distal end of the corresponding channel at any one time.

In a particular case, the method is for exactly five reciprocating pistons. In another case, the high-pressure water is expelled to a closeable water nozzle. Where reciprocation of the pistons is ceased if the closeable water nozzle is closed. In another case, cleaning solution is added to the expelled water.

In a further embodiment, there is provided a method of manufacturing the wobble plate piston water pump that is described in the embodiments herein.

Applicant recognized numerous advantages of the embodiments described herein, and particularly, for a five piston arrangement over that of a conventional three piston pump arrangement. For example, Applicant recognized that a five piston arrangement will generally provide a more stable fluid output than the three piston arrangement. This is because there is a shorter delay between consecutive water bursts, as the pistons sequentially provide fluid output. There is also the intended advantage of being able to increase both water pressure and water flow at the same time.

As another exemplary recognized advantage, in order to maintain a common fluid output for the five piston arrangement compared to the three piston arrangement, using a common motor, a smaller diameter piston can be employed. This is because the total channel volume required can be divided by 5 rather than 3. In this case, the power required to drive the wobble plate in view of the counter-force of the water in the channels is decreased.

Hence, the motor can operate at a lower current (for electric motors) or with lower fuel consumption (for a gas motor) in the five piston arrangement as compared to the three piston arrangement, provided a common fluid output is desired. This may be important, because there is generally a constraint on the maximum current available to the motor in electric usage (for example, 15 Amperes in a 120 volt or 200 volt electrical system) and there is an immediate cost implication in gas usage (i.e., by reducing consumption). Conversely, this also permits the same motor to be used to drive a higher fluid flow and/or higher pressure in the five piston arrangement as compared to the three piston arrangement, in case there is a desire to drive the motor at maximum capacity.

As another exemplary recognized advantage, since it is possible to reduce piston travel in the channel with more pistons, the wobble plate piston water pump can tend to become quieter and have a longer life span.

As another exemplary recognized advantage, Applicant measured the performance increase of the five piston water pump over the three piston water pump to be approximately 20% to 25% in particular exemplary cases.

Applicant has also recognized advantages of the embodiments with a four piston arrangement over the conventional three piston arrangement. Relative to the three piston water pump, Applicant measured the performance of the four piston water pump to be increased by approximately 7% while the size is only increased by approximately 15%. Additionally, the difficulty of machining the pump can be decreased.

Applicant has also recognized advantages of the embodiments with a six piston arrangement over the conventional three piston arrangement. Relative to the three piston water pump, Applicant measured the performance of the six piston water pump to be increased by approximately 25%.

Compared with other embodiments having other piston quantities, Applicant has recognized the relative advantages of the five piston arrangement. For example, compared to a six piston arrangement, the measured performance of the five piston water pump is only a small decrease of approximately 7%. What is more, since the rigidity of a pump body of the six piston water pump is weaker than the five piston pump, the compressive strength of the six piston water pump needs to be maintained by increasing the size and the wall thickness of the whole pump body. This increase can result in increased cost and weight. In another example, compared to other piston arrangements, the five piston arrangement can have ideal even distribution among the pitch circle.

In a further example, compared to even-numbered piston arrangements, such as a four piston arrangement or a six piston arrangement, a five piston arrangement can have greater long term strength. Since even-numbered piston arrangements belong to an even-number vibrating body, it is possible that those arrangements can be accidentally damaged due to resonance of the pump body during operation.

Having discovered the advantages of a five piston pump arrangement for a pressure washer, Applicant conducted technical analyses to demonstrate some of such advantages. One such analysis, which is described below, involved comparing an exemplary embodiment of a five piston arrangement with that of two exemplary embodiments of conventional three piston arrangements.

For pressure washers, the best cleaning effects are typically realized when the working pressure and flow reaches an optimum ratio. Accurate measurement of the effect of cleaning from a pressure washer is determined by an impact force formula:

$$IP=0.24*GPM*3.785*SQRT(PSI*0.07/0.98)$$

whereby GPM is gallons per minute and PSI is pounds per square inch.

Figure 5:
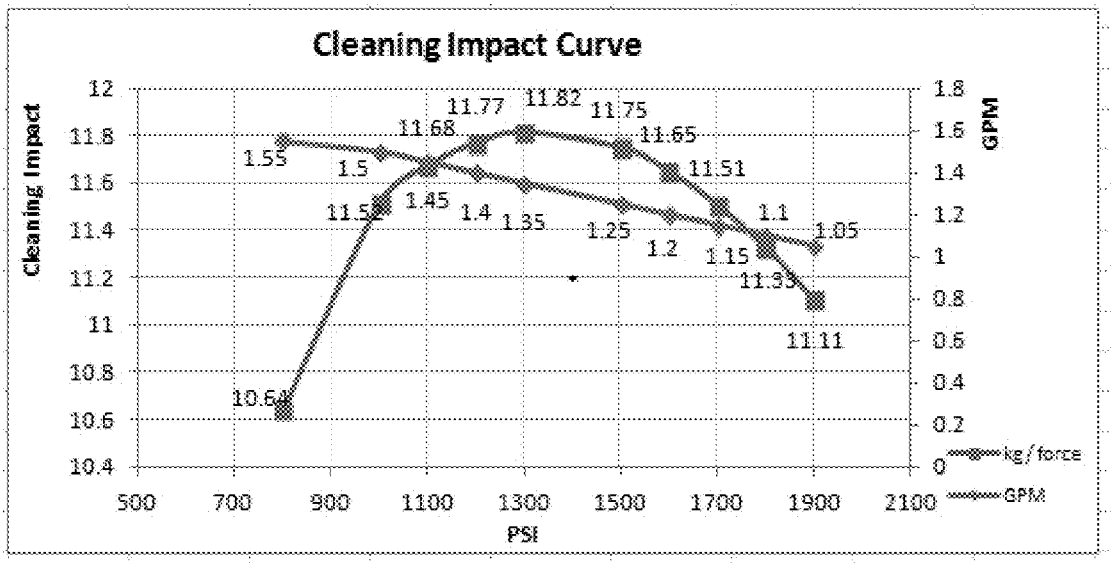
FIG. 5 is a graph illustrating a curve of cleaning impact force.

The higher the IP value is, the better the cleaning effect will be, and vice versa. The curve of cleaning impact force is an inverse parabola as shown in the example of FIG. 5.

From the cleaning impact formula it can be gleaned that the cleaning effect is linked to the working pressure and flow, but the flow has larger effect on the results than the pressure. An improvement of the cleaning effect of the pressure washer is therefore mainly accomplished by increasing the work flow.

With respect to conventional three piston arrangements for high pressure washers, the following will show that, from the results of calculation and analysis by the Applicant, only changing the angle and diameter of the pistons to increase the work flow may in fact cause the three piston pump design to fail to work as desired.

As an example, the following is a technical analysis on a conventional three piston water pump having a diameter of the pistons of 12 mm, a diameter of a pitch circle of the pistons of 42 mm, and the wobble plate having an angle of 8 degrees. Through an analysis of parameters and performance of the conventional three piston water pump, the relationship of the output power of the motor, the working pressure, and the work flow rate for the best cleaning effect was obtained.

For this pump arrangement, the single circulation stroke of each piston is calculated as:

$$L=\tan(8)*42=5.9 \text{ mm}.$$

The single circulation flow of each piston is calculated to be:

$$V=\pi*r^2*L*\delta=3.14*0.6^2*0.59*0.73=0.487 \text{ cm}^3;$$

Whereby the volumetric efficiency of the 12 mm piston is taken to be $\delta=0.73$.

The flow per minute Q is taken to be:

$$Q=0.487/1000*3*3600/3.785=1.39 \text{ GPM}.$$

For this pump arrangement, the induction motor that drives the pump has a rated voltage (V) of 120V/60 Hz, with a motor speed of 3600 rpm, and a maximum working current (I) of 15 A. According to the equation for the motor output power: HP=V*I*Eff/746, the motor efficiency Eff is 60%. The maximum output power of the motor is 1.4 HP.

The thrust generated by the motor driving the wobble plate to rotate can be obtained by the screw thrust formula:

$$Fa=2\times\pi*\eta1*T/L$$

Whereby the drag coefficient (L) of the wobble plate, thrust ball bearing and piston is 0.025, the positive efficiency of slope of 8 degrees η1 is 85%, the motor output torque (T) is 5252*HP/RPM=2.85 Nm.

Using the screw thrust formula, the maximum thrust in the tangential direction caused by 8-degree inclined plate on the piston is given by:

$$Fa=2*\pi*0.85*2.85/5.9*10^{-3}=2602\text{ N (265 kg)}$$

The maximum thrust caused by the 8-degree inclined plate on piston in the horizontal axial direction is given by:

$$Fx=Fa*\cos(8)=2576.8\text{N (262.4 kg)}$$

The maximum thrust caused by the 8-degree inclined plate on piston in the vertical axial direction is given by:

$$Fy=Fa*\sin(8)=362.2\text{ N (36.9 kg)}$$

Figure 6:
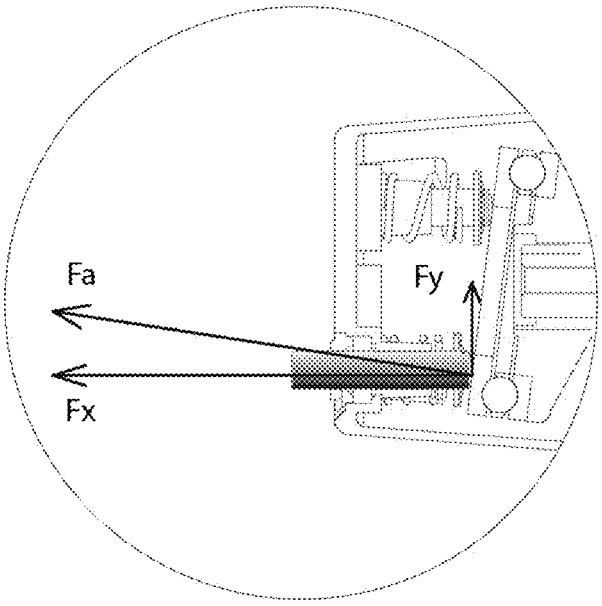
FIG. 6 is a side cut-away view of an exemplary pump illustrating forces on a piston.

FIG. 6 illustrates a side cut-away view of an exemplary pump showing, generally, the screw thrust (Fa), horizontal axial force (Fx) and vertical axial force (Fy) on a piston.

Figure 7:
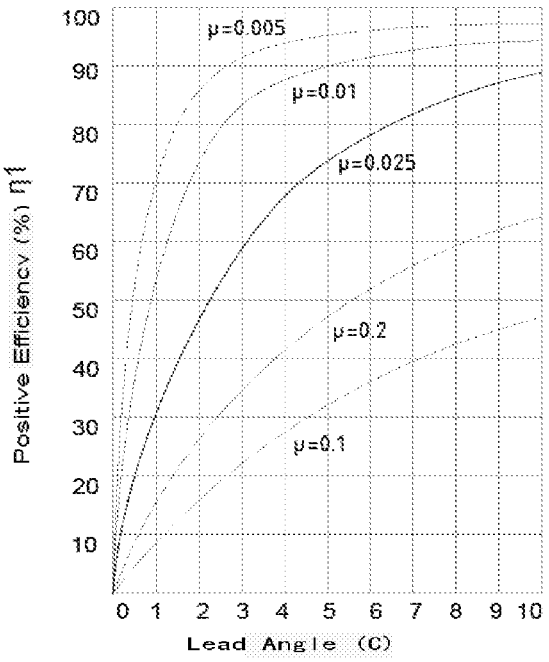
FIG. 7 is a graph illustrating the relationship between positive efficiency vs. lead angle for a conventional three piston arrangement.

FIG. 7 shows the relationship between positive efficiency (represented on the vertical axis) and lead angle (represented on the horizontal axis in degrees).

The hydraulic pressure generated by the water pump is used to estimate the thrust required by the piston. Also it is used to estimate whether it can match with the maximum thrust of the motor. Namely, the axial thrust generated by the motor should be greater than the reaction force generated by high water pressure to the pump.

For this pump arrangement, the maximum working pressure is 1300 PSI (90 kg/cm$^2$) when the flow is 1.39 GPM. In addition, the working current cannot exceed the maximum limit of 15 A.

The total reaction force generated by single one of the pistons is determined by dividing the force into three parts, namely, T=Fp+Ts+Ff.

Whereby Fp is the reaction force generated by the water pressure to each piston:

$$Fp=P*S=90*\pi*0.6^2=101.7\text{ kg}$$

Fs is the reaction force generated by the piston spring to piston:

$$Ts=I+D*k=3+5.2*5.5/10=5.86\text{ kg}$$

Ff is the resistance generated by the rubber sealing ring on piston:

$$Ff=Fy*f$$

The friction coefficient of rubber on D13 piston f=0.66, and the friction resistance is:

$$Ff=36.9*0.66=24.31\text{ kg.}$$

Thus, the total reaction force of a single piston is:

$$T=101.7+5.86+24.31=131.87\text{ kg}$$

While the water pump is operating, two of the three pistons bear the water pressure and friction reaction force, while the third piston is in the returning state and doesn't bear the water pressure or friction reaction force. If two pistons bearing the reaction force, one spring is completely pressed and another piston is at ⅕ of the distance towards the distal end. The spring force for this piston is:

$$Ts(1/5)=I+D/5*k.$$

The total reaction force of pump Fb is:

$$Fb=(Fp+Ff)*2+Ts+Ts(1/5)$$

$$Fb=(101.7+24.31)*2+5.86+3.57=261.5\text{ kg}$$

The horizontal thrust force, Fx (262.2 kg), generated by the motor is less than reaction force of the pump, Fb (261 kg).

For this arrangement, the motor and three piston water pump are working at the point of maximum power. The work flow (1.39 GPM) and working pressure (1300 PSI) are at the optimal ratio, and the cleaning impact (IP) reaches the maximum value.

$$IP=0.24*GPM*3.785*SQRT(PSI*0.07/0.98)$$

$$IP=0.24*1.39*3.785*SQRT(1300*0.07/0.98)$$

$$IP=12.2\text{ kg/force}$$

As another example, the following is a technical analysis on a conventional three piston water pump. In this case, the water pump has a piston diameter of 13 mm, a diameter for the pitch circle of the pistons of 44 mm, and an angle for the wobble plate of 7 degrees. Through an analysis of parameters and performance of the conventional three piston water pump, the relationship of the output power of the motor, the working pressure, and the work flow rate for the best cleaning effect was obtained.

The primary purpose of reducing the angle of the wobble plate was to enhance the working efficiency of the pump by increasing the thrust of piston in the horizontal direction and decrease the pressure on the piston in the vertical direction. Thus, increase the cleaning impact force.

The single circulation stroke of each piston is:

$$L=\tan(7)*44=5.4\text{ mm;}$$

The single circulation flow of each piston is:

$$V=\pi*r^2*L*\delta=3.14*0.65^2*0.59*0.73=0.487\text{ cm}^3;$$

Whereby the volumetric efficiency of the 13 mm piston is δ=0.70, and the flow of the pump per minute is:

$$Q=0.5/1000*3*3600/3.785=1.43\text{ GPM.}$$

For this arrangement, the pump uses an induction motor as the driving force. The induction motor has a rated voltage (V) of 120V/60 Hz, a motor speed of 3600 rpm, and a maximum working current (I) of 15 A. According to the equation for motor output power: HP=V*I*Eff/746, the motor efficiency Eff is 60%. The maximum output power of the motor is 1.4 HP.

The thrust generated by the motor driving the wobble plate to rotate can be obtained from the screw thrust formula:

$$Fa=2\times\pi*\eta1*T/L,$$

The drag coefficient (L) of the wobble plate, thrust ball bearing and piston is 0.025. The positive efficiency of slope of 7 degrees η1 is 82%. The motor output torque, T, is 5252*HP/RPM=2.85 Nm.

The maximum thrust in the tangential direction caused by 7-degree inclined plate on the piston is:

$$Fa=2*\pi*0.82*2.85/5.4*10^{-3}=2717.8\text{ N (277 kg)}$$

The maximum thrust caused by the 7-degree inclined plate on piston in the horizontal axial direction is:

$$Fx=Fa*\cos(7)=2697.4N(331.6\ kg)$$

The maximum thrust caused by the 7-degree inclined plate on piston in the vertical axial direction is:

$$Fy=Fa*\sin(7)=274.9\ N\ (33.8\ kg)$$

Figure 8:
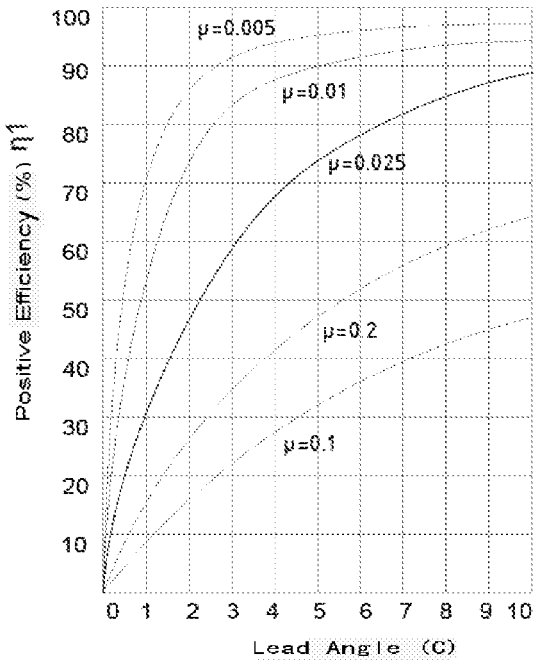
FIG. 8 is a graph illustrating the relationship between positive efficiency vs. lead angle for a further conventional three piston arrangement.

FIG. 8 shows the relationship between positive efficiency (represented on the vertical axis) and lead angle (represented on the horizontal axis in degrees).

Whereby, the hydraulic pressure generated by the high-pressure water pump is used to estimate the thrust required by the piston, and whether it can match with the maximum thrust of the motor. Namely, the axial thrust generated by the motor should be greater than the reaction force generated by high water pressure to the pump.

For this arrangement, the maximum working pressure is 1300 PSI (90 kg/cm$^2$) when the flow is 1.43 GPM. At that time, the working current cannot exceed the maximum limit of 15 A.

The total reaction force generated by one of the pistons is obtained by dividing the force into three parts:

$$T=Fp+Ts+Ff.$$

Fp is the reaction force generated by the water pressure to each piston:

$$Fp=P*S=90*\pi*0.65^2=119.4\ kg$$

Fs is the reaction force generated by the piston spring on the piston:

$$Ts=I+D*k=3+5.2*5.5/10=5.86\ kg$$

Ff is the resistance generated by the rubber sealing ring on the piston:

$$Ff=Fy*f$$

Whereby, the friction coefficient of rubber on D13 piston f=0.72, and the friction resistance is:

$$Ff=33.8*0.72=24.15\ kg$$

The total reaction force of a single piston is:

$$T=119.4+5.86+24.15=149.41\ kg$$

While the water pump is operating, two of the three pistons bear the water pressure and friction reaction force, while the third piston is in the returning state and doesn't bear the water pressure or friction reaction force. If two pistons bearing the reaction force, one spring is completely pressed and another piston is at ⅕ of the distance towards the distal end. The spring force for this piston is at ⅕ of the distance towards the distal end. The spring force for this piston is:

$$Ts(1/5)=I+D/5*k.$$

The total reaction force of the pump is:

$$Fb=(Fp+Ff)*2+Ts+Ts(1/5)$$

$$Fb=(119.4+24.15)*2+5.86+3.57=296.5\ kg$$

The horizontal thrust force, Fx (274.9 kg), generated by the motor is less than the reaction force of the pump, Fb (296.5 kg). Thus, the output power of the motor cannot meet the requirements for normal working conditions of the water pump. The motor needs to consume higher current. Once the current exceeds a safety value, it can cause a fault on the power supply.

The cleaning impact force of this arrangement is:

$$IP=0.24*GPM*3.785*SQRT(PSI*0.07/0.98)=12.55\ kg/force$$

Even if the current does not exceed the safety value, the cleaning impact force is only increased by 3% over the previous exemplary arrangement, and the change of the parameters is generally not practical.

Therefore, for a three piston pump, it is generally not feasible to increase the effect of cleaning by decreasing the angle of the wobble plate and increasing the diameter of the piston.

As an example, the following is a technical analysis of a five piston water pump according to an embodiment herein. The five piston water pump has a diameter of the pistons of 10 mm, a diameter of a pitch circle of the pistons of 48 mm, and an angle of an inclined plate of 6.5 degrees.

Again, the primary purpose of reducing the angle of the wobble plate is to enhance working efficiency of the pump by increasing the thrust of piston in the horizontal direction, while decreasing the pressure on the piston in the vertical direction. Thus increasing the cleaning impact force.

For this arrangement, the single circulation stroke of each piston is:

$$L=\tan(6.5)*48=5.5\ mm$$

The single circulation flow of each piston is:

$$V=\pi*r^2*L*\delta=3.14*0.5^2*0.55*0.8=0.345\ cm^3$$

Whereby, the volumetric efficiency of the 10 mm piston is δ=0.80 and the flow of the pump per minute is Q:

$$Q=0.345/1000*5*3600/3.785=1.64\ GPM$$

For this arrangement, the pump is driven by an induction motor. The induction motor has a rated voltage (V) of 120V/60 Hz, a motor speed of 3600 rpm, and a maximum working current (I) of 15 A.

According to the equation of the motor output power: HP=V*I*Eff/746, the motor efficiency Eff is 60%. The maximum output power of the motor is 1.4 HP.

The thrust generating by the motor driving the wobble plate to rotate can be obtained from the screw thrust formula:

$$Fa=2\times\pi r*\eta 1*T/L.$$

The drag coefficient (L) of the wobble plate, thrust ball bearing and piston is 0.025. The positive efficiency of the slope of 6.5 degrees η1 is 80%. The motor output torque is T=5252*HP/RPM=2.85 Nm.

The maximum thrust in the tangential direction caused by 6.5-degree inclined plate on the piston is:

$$Fa=2*\pi*0.80*2.85/5.4*10^{-3}=2651.5\ N(270.4\ kg)$$

The maximum thrust caused by the 6.5-degree inclined plate on the piston in the horizontal axial direction is:

$$Fx=Fa*\cos(6.5)=2636.6\ N(268.9\ kg)$$

The maximum thrust caused by the 6.5-degree inclined plate on the piston in the vertical axial direction is:

$$Fy=Fa*\sin(6.5)=299.6\ N(30.6\ kg)$$

Figure 9:
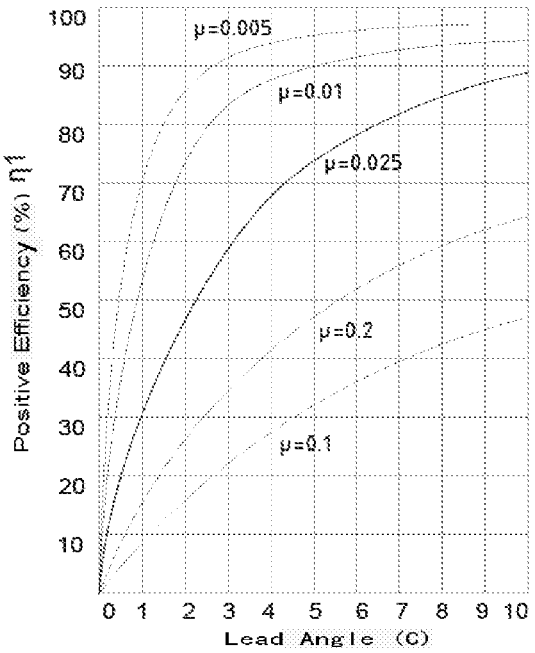
FIG. 9 is a graph illustrating the relationship between positive efficiency vs. lead angle for a five piston arrangement according to an embodiment.

FIG. 9 shows the relationship between positive efficiency (represented on the vertical axis) and lead angle (represented on the horizontal axis in degrees).

Whereby, the hydraulic pressure generated by the water pump is used to estimate the thrust required by the piston. It is also used to estimate whether the pump can match with the maximum thrust of the motor. Namely, the axial thrust generated by the motor should be greater than the reaction force generated by high water pressure to the pump.

For this arrangement, the pump has a maximum working pressure of 1300 PSI (90 kg/cm$^2$) when the flow is 1.64 GPM. At that time, the working current cannot exceed the maximum limit of 15 A.

The total reaction force generated by a single one of the pistons by dividing the force into three parts:

$$T=Fp+Ts+Ff.$$

Fp is the reaction force generated by the water pressure to each piston:

$$Fp=P*S=90*\pi*0.5^2=70.65 \text{ kg}$$

Fs is the reaction force generated by the piston spring on the piston:

$$Ts=I+D*k=3+5.2*5.5/10=5.86 \text{ kg}$$

Ff is the resistance generated by the rubber sealing ring on the piston $$Ff=Fy*f$$

The friction coefficient of rubber on the piston is f=0.72, and the friction resistance is:

$$Ff=30.6*0.55=16.83 \text{ kg}$$

The total reaction force on a single piston is:

$$T=70.65+5.86+16.83=90.34 \text{ kg}$$

While the water pump is operating, three out of the five pistons bear the water pressure and friction reaction force. The remaining two pistons will, as part of the reciprocating cycle, be in the state of returning and will not bear the water pressure and friction reaction force. At a certain point in the cycle, for the three pistons bearing the reaction force, one spring will be completely compressed; another piston will be at ⅗ of the length to the distal end, and the last piston will be at 1/10 of the length to the distal end. The spring force the last piston will be:

$$Ts(1/10)=I+D3/10*k.$$

The total reaction force of the pump is:

$$Fb=(Fp+Ff)*3+Ts+Ts(3/5)+Ts(1/10)$$

$$Fb=(70.65+16.83)*3+5.86*(1+3/5+1/10)=272.4 \text{ kg}$$

The horizontal thrust, Fx (268.9 kg), generated by the motor is close to reaction force of the pump, Fb (272.4 kg). Thus, the output power of the motor cannot meet the requirements for normal working conditions of the water pump. However, the rated current of the motor can be maintained within a range for safe operation.

For this arrangement, the cleaning impact (IP) is:

$$IP=0.24*GPM*3.785*SQRT(PSI*0.07/0.98)$$

$$IP=0.24*1.64*3.785*SQRT(1300*0.07/0.98)$$

$$IP=14.36 \text{ kg/force}$$

For this arrangement, the motor and five piston pump are working at the point of maximum power. The operating flow (1.64 GPM) and the operating pressure (1300 PSI) are at a practically optimal ratio. Thus, the cleaning impact (IP) also reaches a practically optimal value.

Thus, compared to the first exemplary arrangement for a three piston pump, the cleaning impact force is increased by 18%. Therefore, the five piston pump has clearly enumerated advantages of the conventional three piston arrangement. Particularly, the five piston pump has enhanced the operating flow and cleaning effects, due to, in this case, increasing the number of pistons to five, decreasing the angle of the wobble plate, and decreasing the diameter of the piston.

Although the foregoing has been described with reference to certain specific embodiments, various modifications thereto will be apparent to those skilled in the art without departing from the spirit and scope of the invention as outlined in the appended claims. The entire disclosures of all references recited above are incorporated herein by reference.

The invention claimed is:

1. A wobble plate piston water pump for use in a pressure washer and driven by a driving source, the driving source being electric powered and having a power consumption of less than or equal to a 15 ampere draw at 120 volts or 220 volts or the driving source being gas powered and having an engine displacement of less than or equal to 250 cubic centimetres, the water pump comprising:

a pump body defining five channels;

a wobble plate disposed in the pump body and having a rear side and a front side, the wobble plate being rotatable around a rotational axis via mechanical connection on the rear side to the driving source, the front side being inclined at an angle between 5 degrees and 10 degrees perpendicular to the rotational axis and coupled to the rear side by four equally annularly spaced thrust bearings, the wobble plate comprising a pitch circle having a diameter defined by the annular spacing of the thrust bearings;

five equally annularly spaced pistons each having a proximate end and a distal end, each piston located in a respective one of the five channels and each having a spring retainer located on the proximate end, the spring retainer of each piston being biased to contact the front side of the wobble plate, the pistons being reciprocatable within the channels along an axis transverse to the rotational axis during rotation of the wobble plate, the pistons defining a pitch circle having a diameter defined by the annular spacing of the pistons that is smaller than the wobble plate pitch circle diameter; and a water passage defined by a water inlet and a water outlet each in selective fluid communication with one of the five of channels based on a phase of reciprocation of the respective piston for that channel, the water inlet providing low pressure water to the channel while the respective piston for that channel is moving away from the water inlet, and the water outlet receiving high pressure water from the channel while the piston is moving towards the water outlet.

2. The wobble plate piston water pump of claim 1, further comprising a power-off subassembly located intermediate the water outlet and a closeable water nozzle, the power-off subassembly defining a push rod cavity for receiving water from the water outlet, the power off subassembly comprising:

a push rod at least partially located in the push rod cavity, the push rod moveably biased towards being in the push rod cavity; and a microswitch electrical connected to a power supply of the driving source, the microswitch positioned such that push rod contacts the microswitch when the push rod cavity is substantially filled with water due to a closed water nozzle, and contact with the microswitch by the push rod turns off power to the driving source.

3. The wobble plate piston water pump of claim 1, wherein the driving source is an electric motor and the diameter of each of the pistons is between 8 mm and 14 mm.

4. The wobble plate piston water pump of claim 3, wherein the diameter of each of the pistons is greater than 12 mm.

5. The wobble plate piston water pump of claim 1, wherein the driving source is a gas engine and the diameter of each of the pistons is between 10 mm and 16 mm.

6. The wobble plate piston water pump of claim 5, wherein the diameter of each of the pistons is greater than 12 mm.

7. The wobble plate piston water pump of claim 1, wherein each of the five channels has an annularly periphery, and an entirety of the five annular peripheries are formed entirely within the wobble plate pitch circle diameter.

* * * * *